US007544157B2

(12) United States Patent
Teeter et al.

(10) Patent No.: US 7,544,157 B2
(45) **Date of Patent: *Jun. 9, 2009**

(54) POWER DRIVEN TILTING INVERSION EXERCISER

(76) Inventors: Roger C. Teeter, 20720 Snag Island Dr., Sumner, WA (US) 98390; Lo Pin Wang, 16F-2, No. 17, Lane 52, Sec. 3, Rehe Road, Beitun Chu, Taichung 40652 (TW)

( * ) Notice: Subject to any disclaimer, the term of this patent is extended or adjusted under 35 U.S.C. 154(b) by 25 days.

This patent is subject to a terminal disclaimer.

(21) Appl. No.: 11/434,460

(22) Filed: May 15, 2006

(65) Prior Publication Data

US 2007/0265150 A1 Nov. 15, 2007

(51) Int. Cl.
*A63B 26/00* (2006.01)

(52) U.S. Cl. ..... 482/144; 482/145

(58) Field of Classification Search ..... 482/146–7, 482/144–145

See application file for complete search history.

(56) References Cited

U.S. PATENT DOCUMENTS

| | | | | |
|---|---|---|---|---|
| 3,152,802 | A * | 10/1964 | Heisler et al. | 482/144 |
| 3,570,479 | A * | 3/1971 | Horn | 482/145 |
| 4,672,697 | A * | 6/1987 | Schurch | 5/610 |
| 4,717,148 | A * | 1/1988 | Brewer | 482/144 |
| 5,044,358 | A | 9/1991 | Morin | 128/71 |
| 5,295,936 | A | 3/1994 | Perry, Jr. | 482/144 |
| 5,551,937 | A * | 9/1996 | Kwo | 482/144 |
| 5,718,660 | A * | 2/1998 | Chen | 482/144 |
| 6,030,325 | A * | 2/2000 | Ottoson et al. | 482/144 |
| 6,679,818 | B2 * | 1/2004 | Hsien | 482/144 |
| 7,077,795 | B2 * | 7/2006 | Chen | 482/145 |
| 7,374,521 | B2 * | 5/2008 | Wang | 482/145 |
| 2003/0153442 | A1 * | 8/2003 | Kuo | 482/144 |
| 2007/0161477 | A1 * | 7/2007 | Wang | 482/144 |

* cited by examiner

*Primary Examiner*—Lori Amerson
(74) *Attorney, Agent, or Firm*—Charles E. Baxley

(57) ABSTRACT

A tilting inversion exerciser includes a table rotatably supported on a supporting stand, a foot retaining device for being powered and actuated to clamp and to retain ankle portions of the user to the table without being operated manually by the user. A motorized coupling device may move and adjust the table relative to the stand. A safety device may be used for switching off the foot retaining device to prevent the ankle portions of the user from being disengaged from the foot retaining device inadvertently when the table is operated by the user, particularly when the table and the user are rotated to a vertical position relative to the supporting stand and the ground.

8 Claims, 7 Drawing Sheets

POWER DRIVEN TILTING INVERSION EXERCISER

BACKGROUND OF THE INVENTION

1. Field of the Invention

The present invention relates to a tilting inversion exerciser, and more particularly to a tilting inversion exerciser having a power rotating ankle holder or foot retaining device for detachably securing the ankle portions of the user to the table of the tilting inversion exerciser and having a safety device for switching off the ankle holder or foot retaining device and for preventing the ankle holder or foot retaining device from being operated or actuated inadvertently, particularly when the tilting inversion exerciser is rotated or operated relative to the supporting stand by the user.

2. Description of the Prior Art

Typical tilting inversion exercisers comprise a base or table pivotally or rotatably supported on a lower support stand, for supporting a user thereon, and for allowing the user to tilt or to incline the table relative to the lower support, in order to conduct the typical tilting inversion exercises, and comprise an ankle holder or foot retaining device attached to the table for detachably securing the ankle portions of the user to the table of the tilting inversion exerciser.

For example, U.S. Pat. No. 5,295,936 to Perry, Jr. discloses one of the typical adductor contraction exercise devices comprising a platform rotatably supported on a supporting stand for supporting a user thereon, and a crosspiece having two pads for engaging with the feet or the ankle portions of the user for detachably securing the ankle portions of the user to the tilting inversion exerciser. However, the ankle portions or the feet of the user may not be solidly secured to the platform such that the ankle portions or the feet of the user may have a good chance to be disengaged from the platform particularly when the platform is inverted relative to the ground.

U.S. Pat. No. 5,044,358 to Morin discloses another typical rotatable treatment bench also comprising a base or table pivotally or rotatably supported on a lower support, and a manually operated locking device pivotally attached to a foot rest for being rotated relative to the foot rest to clamp and to retain the feet of the user to the base or table.

However, the locking device or ankle holder or foot retaining device is required to be operated manually, but may not be operated by power driving apparatuses. It will be difficult for some of the users to bend over their bodies and to reach and to manually operate the locking device when the user has lain on the table of the inversion exercises.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including a power rotating ankle holder or foot retaining device for being powered to grasp and retain or to detachably secure the ankle portions of the user to the tilting inversion exerciser.

The other objective of the present invention is to provide a tilting inversion exerciser including a safety device for switching off the ankle holder or foot retaining device and for preventing the ankle holder or foot retaining device from being operated or actuated inadvertently, particularly when the tilting inversion exerciser is rotated or operated relative to the supporting stand by the user.

In accordance with one aspect of the invention, there is provided a tilting inversion exerciser comprising a supporting stand, a table rotatably supported on the supporting stand with a pivot axle for supporting a user on the table, a power actuating foot retaining device attached to the table for being powered and actuated to clamp and to retain ankle portions of the user to the table, and a safety device for switching off the foot retaining device to prevent the ankle portions of the user from being disengaged from the foot retaining device inadvertently when the table is operated by the user.

The table includes two fixed foot supports for supporting the feet of the user, the foot retaining device includes a tube attached to the table, a stem slidably attached to the tube, two foot anchor members attached to the stem and movable toward and away from the fixed foot supports for clamping and retaining the feet of the user to the table, and device for moving the foot anchor members relative to the fixed foot supports.

The moving device includes a threaded shank rotatably disposed in the tube, and a threaded member secured in the stem and threaded with the threaded shank for allowing the threaded member and the stem to be moved and adjusted relative to the tube. The moving device includes a motor coupled to the threaded shank for rotating and driving the threaded shank.

The table includes a control device having an electric cable coupled to two switch contacts for selectively coupling to the motor. The motor includes an electric cable coupled to two conductors for selectively engaging with the switch contacts of the control device.

The foot retaining device includes an extension extended from the table for supporting the tube and the fixed foot supports. The extension includes an insulating member attached to the extension for engaging with the conductors of the motor.

The table includes two side portions, two pivot coupling devices each include an axle provided on a middle portion thereof for pivotally attaching to the supporting stand, and each include a first arm extended therefrom and secured to the side portions of the table respectively, for allowing the table to be offset from the axles of the pivot coupling devices.

A rotating device may further be provided for rotating the pivot coupling device relative to the supporting stand, to rotate the table relative to the supporting stand. The first pivot coupling device includes a second arm extended therefrom, the rotating device includes a motor-driven threaded member for coupling to the second arm of the first pivot coupling device for rotating the pivot coupling device and the table relative to the supporting stand.

The rotating device includes a tube coupled to the second arm of the first pivot coupling device and threaded with the threaded member. The second arm of the first pivot coupling device includes a bracket provided on a free end portion for coupling to the tube. The rotating device includes a motor attached to the supporting stand, and the threaded member is coupled to and rotated and driven by the motor.

The rotating device includes a sleeve extended from the motor and engaged onto the threaded member for shielding and protecting the threaded member. The first arm and the second arm of the first pivot coupling device form an L-shaped structure.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
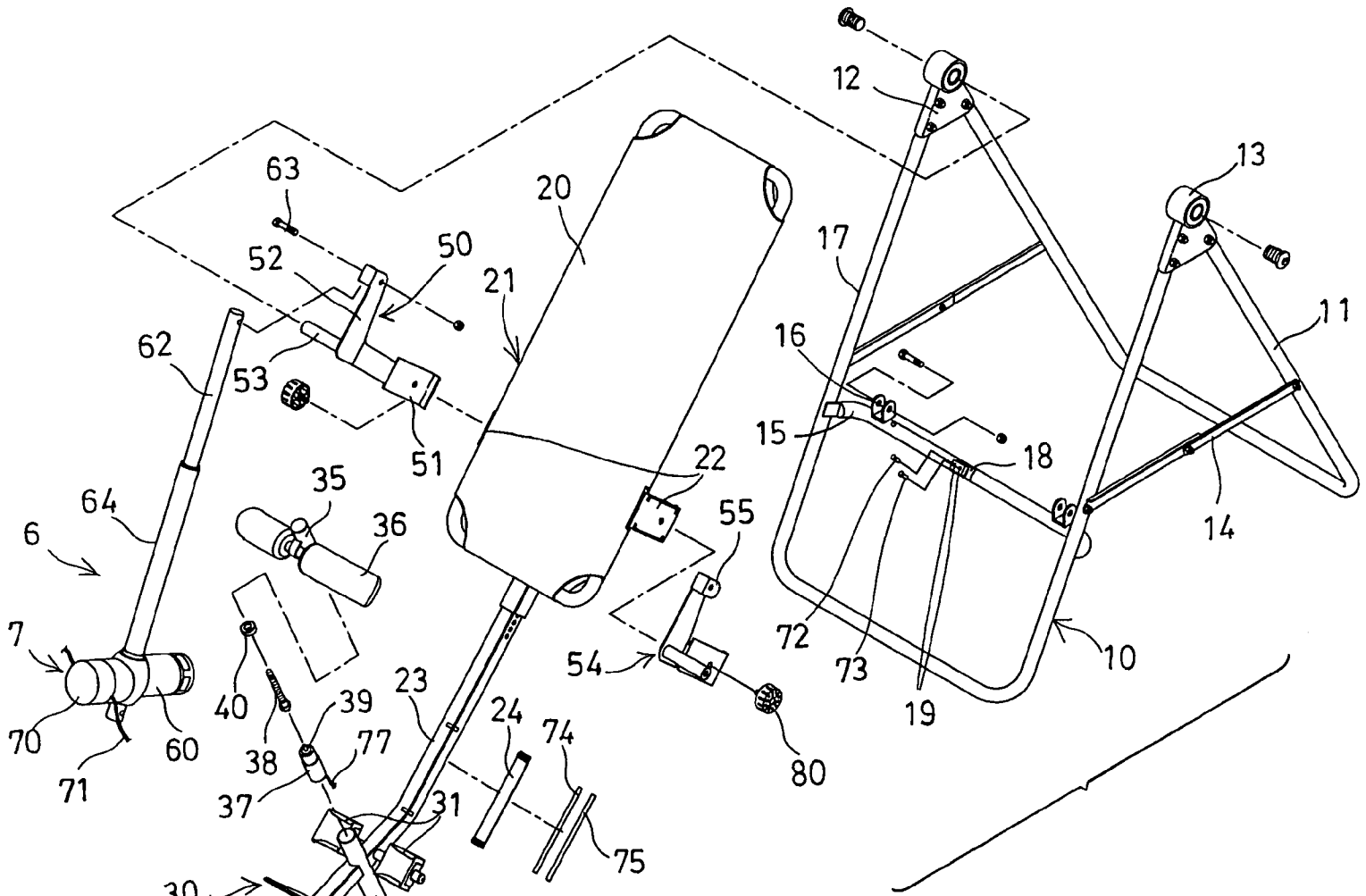
FIG. 1 is an exploded view of a tilting inversion exerciser in accordance with the present invention.
Figure 2:
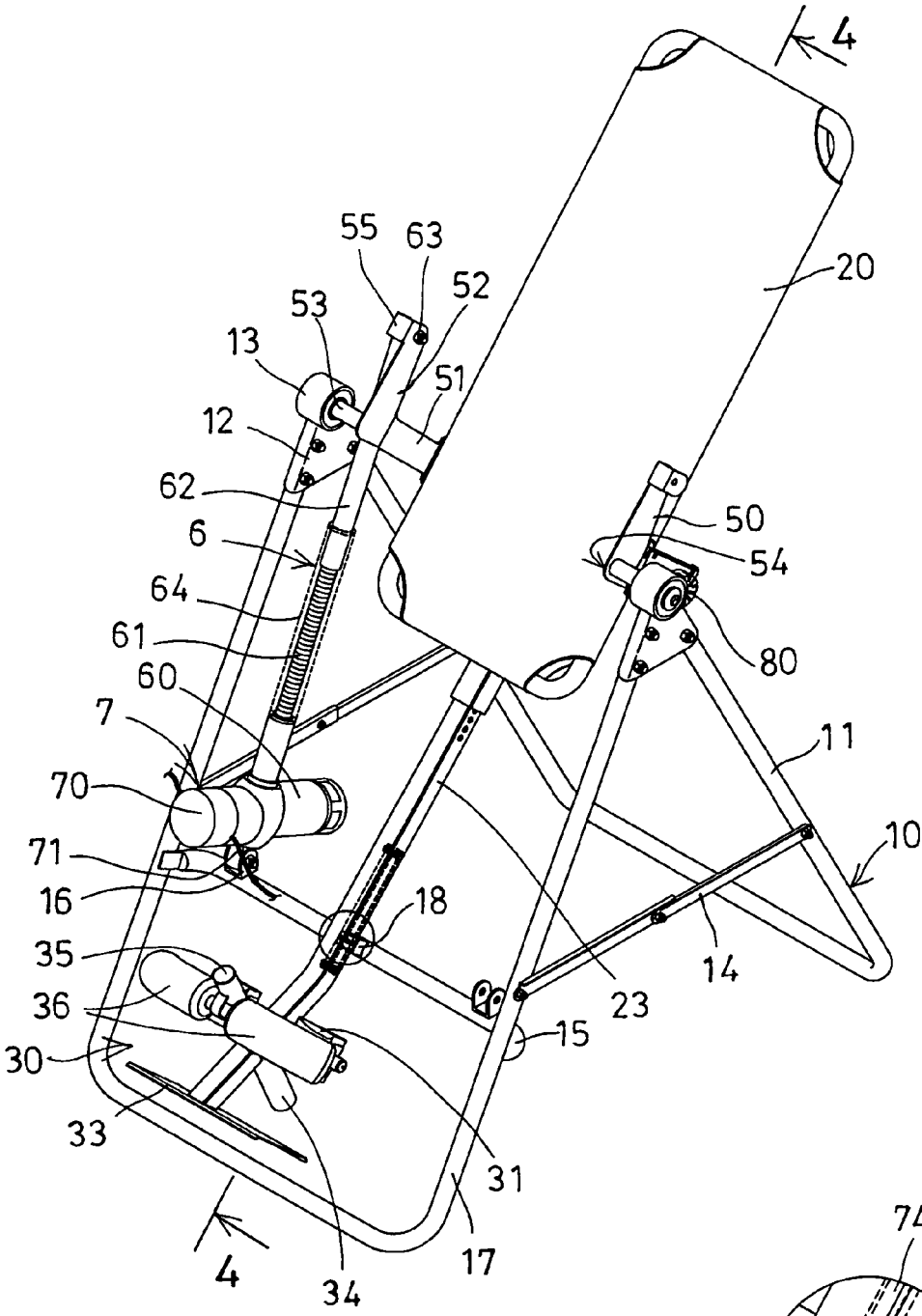
FIG. 2 is an upper perspective view of the tilting inversion exerciser.
Figure 3:
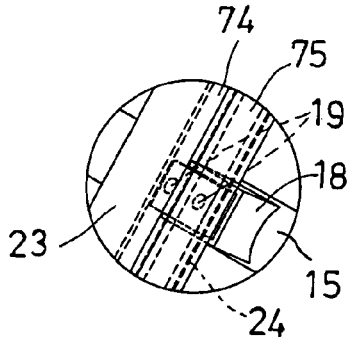
FIG. 3 is an enlarged partial perspective view of the tilting inversion exerciser.

Referring to the drawings, and initially to FIGS. 1-4, a tilting inversion exerciser in accordance with the present invention comprises a lower supporting stand 10 for pivotally or rotatably supporting a base or table 20 thereon, and for supporting a user on the table 20, the lower supporting stand 10 includes such as two U-shaped frames 11 having upper ends pivotally coupled together with two apex members 12 so as to form a substantially inverted V-shaped structure. The lower supporting stand 10 includes a bearing support 13 disposed or attached to each of the apex members 12 for pivotally or rotatably supporting or coupling the supporting table 20.

The lower supporting stand 10 includes one or more, such as two foldable coupler 14 coupled between the frames 11 for allowing the frames 11 of the supporting stand 10 to be folded to a compact folding structure when the foldable coupler 14 is folded, and for allowing the frames 11 of the supporting stand 10 to be stably supported on a working position when the foldable coupler 14 is opened or unfolded to an open position. The lower supporting stand 10 further includes a lever 15 coupled between the legs 17 of one of the frames 11, and one or more brackets 16 attached onto the lever 15.

The table 20 includes two opposite side portions 21, and includes a flap 22 attached or secured to each of the side portions 21 of the table 20. The table 20 further includes an extension 23, such as an adjustable extension 23 attached or coupled or extended from the lower portion thereof for supporting an ankle holder or foot retaining device 30 and for holding or retaining or positioning the feet of the users to the table 20. The extension 23 may be extended or adjusted relative to the table 20 for moving or adjusting the foot retaining device 30 toward or away from the table 20, according to the height of the users, for example.

As shown in FIGS. 1-2, 4 and 6-7, the foot retaining device 30 includes two fixed foot supports 31 attached to the extension 23 and the fixed foot supports 31 each may include a curved recess or soft pad (not shown) attached thereto to comfortably support the feet of the user, such as the ankle portions of the users. The foot retaining device 30 further includes a foot pedal 33 attached to the free end of the extension 23 to further stably support the feet of the user. A cylindrical housing or tube 34 is secured to or extended from or attached to the extension 23 of the table 20 and preferably inclined or perpendicular to the extension 23 for slidably or adjustably receiving or engaging a stem 35 therein, best shown in FIGS. 6-7.

The foot retaining device 30 includes two foot anchor members 36 attached to the stem 35 and movable toward and away from the fixed foot supports 31 of the extension 23 by the stem 35, for clamping or retaining the feet of the user to the extension 23, and for preventing the feet of the user from being disengaged from the extension 23. The foot anchor members 36 of the stem 35 may thus be defined or acted as movable foot anchor members 36 to selectively clamping the feet of the user together with the fixed foot supports 31 of the extension 23. The foot retaining device 30 further includes a moving or actuating means or device 37, such as a motor 37 attached or engaged or secured in the tube 34 and provided for moving the stem 35 and the foot anchor members 36 to clamp the feet of the user.

For example, a bolt or threaded shank 38 is coupled to a spindle 39 of the motor 37 and rotatably received or disposed in the tube 34 with one or more bearings 40 for allowing the threaded shank 38 to be driven or rotated relative to the tube 34 by the motor 37. A nut or threaded member 41 may be disposed and secured in the stem 35 and threaded with the threaded shank 38 for allowing the threaded member 41 and thus the stem 35 to be moved toward or away from the motor 37 or to be adjusted relative to the tube 34, in order to move the stem 35 and the foot anchor members 36 to selectively clamp the feet of the user. The motorized foot retaining device 30 has been disclosed and filed in a co-pending U.S. patent application Ser. No. 11/329,515, filed 11 Jan. 2006 which may be taken as a reference for the present invention.

One or more, such as two pivot coupling devices 50 are provided for coupling the supporting table 20 to the stationary supporting stand 10, and include one or first arm 51 for securing to the respective side portions 21 or the flaps 22 of the table 20 with one or more fasteners 80 (FIGS. 1, 2), and another or second arm 52 bent relative to the arm 51 for forming a substantially L-shaped structure. The pivot coupling devices 50 each further includes an axle 53 attached to or provided on a middle portion 54 thereof and pivotally or rotatably coupled to the bearing supports 13 of the stationary supporting stand 10, for stably supporting and coupling the table 20 to the stationary supporting stand 10. A bracket 55 may be attached to or formed or provided on the free end portion of the other arm 52 of each of the pivot coupling devices 50.

Figure 4:
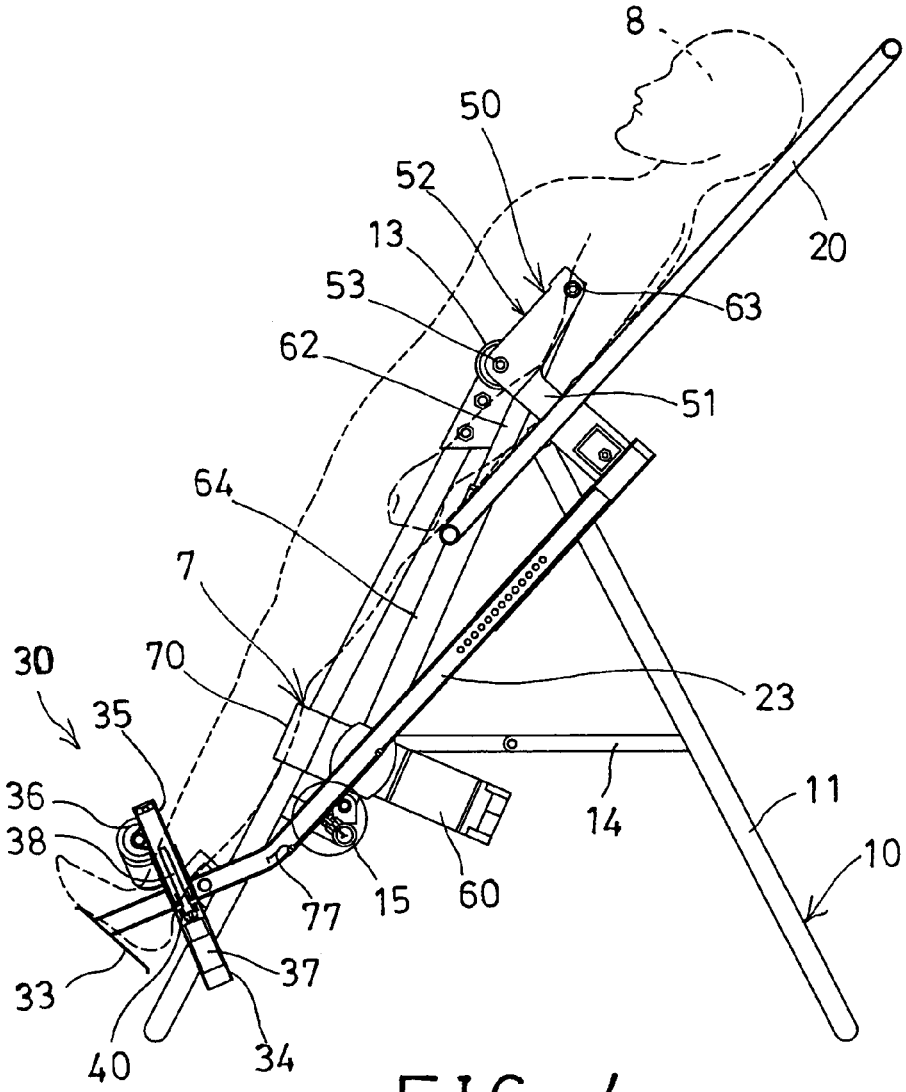
FIG. 4 is a partial cross sectional view of the tilting inversion exerciser, taken along lines 4-4 of FIG. 2.
Figure 5:
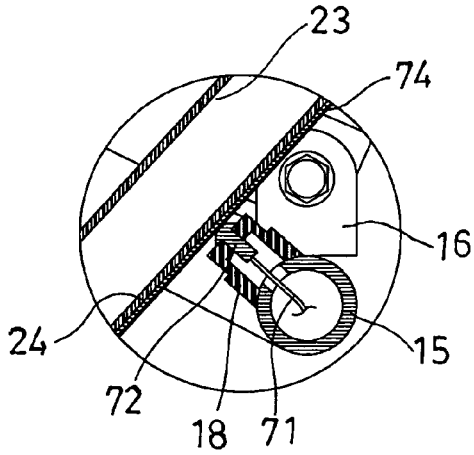
FIG. 5 is an enlarged partial sectional view of the tilting inversion exerciser.
Figure 8:
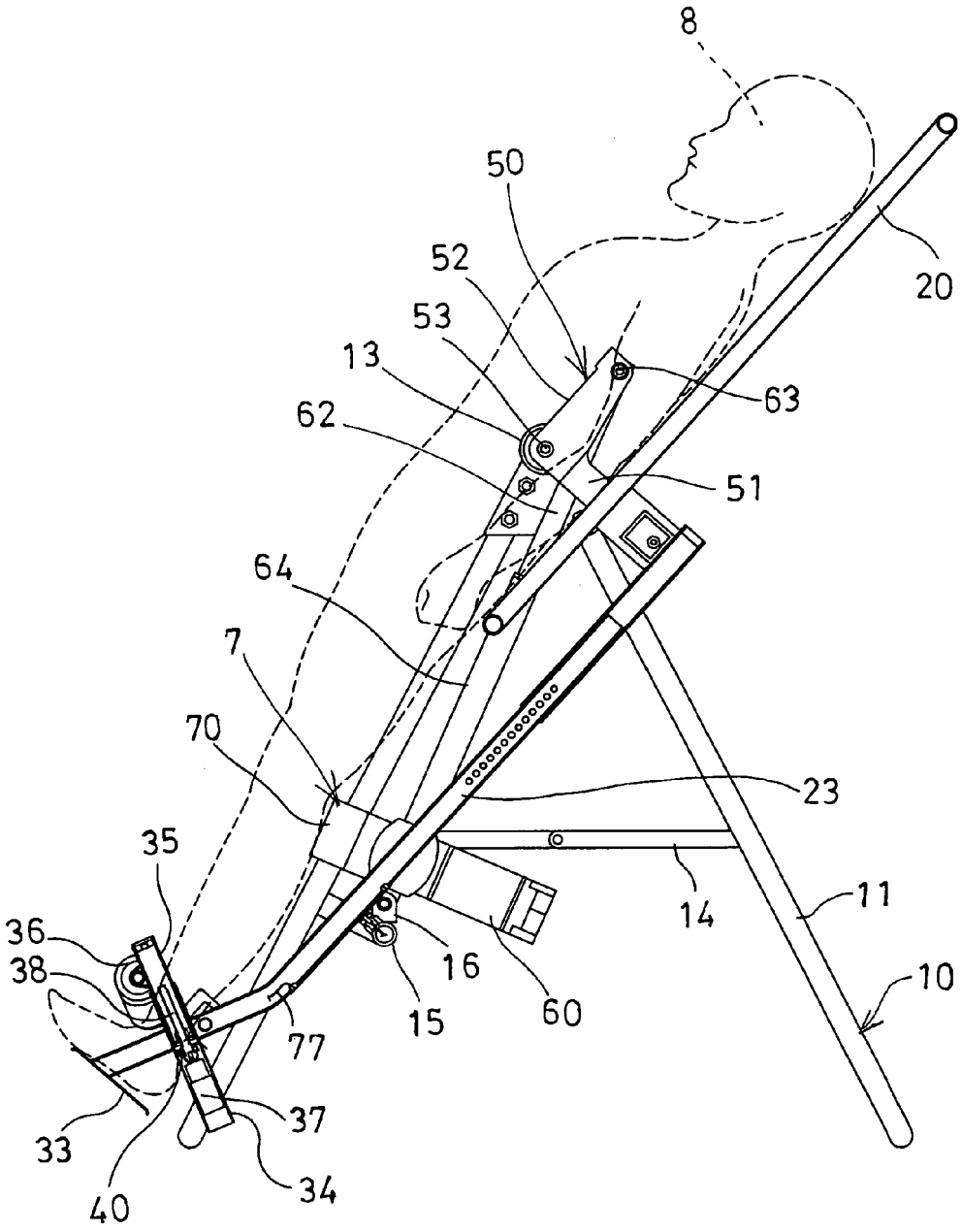
FIG. 8 is a partial sectional view similar to FIG. 4, illustrating the operation of the tilting inversion exerciser.
Figure 9:
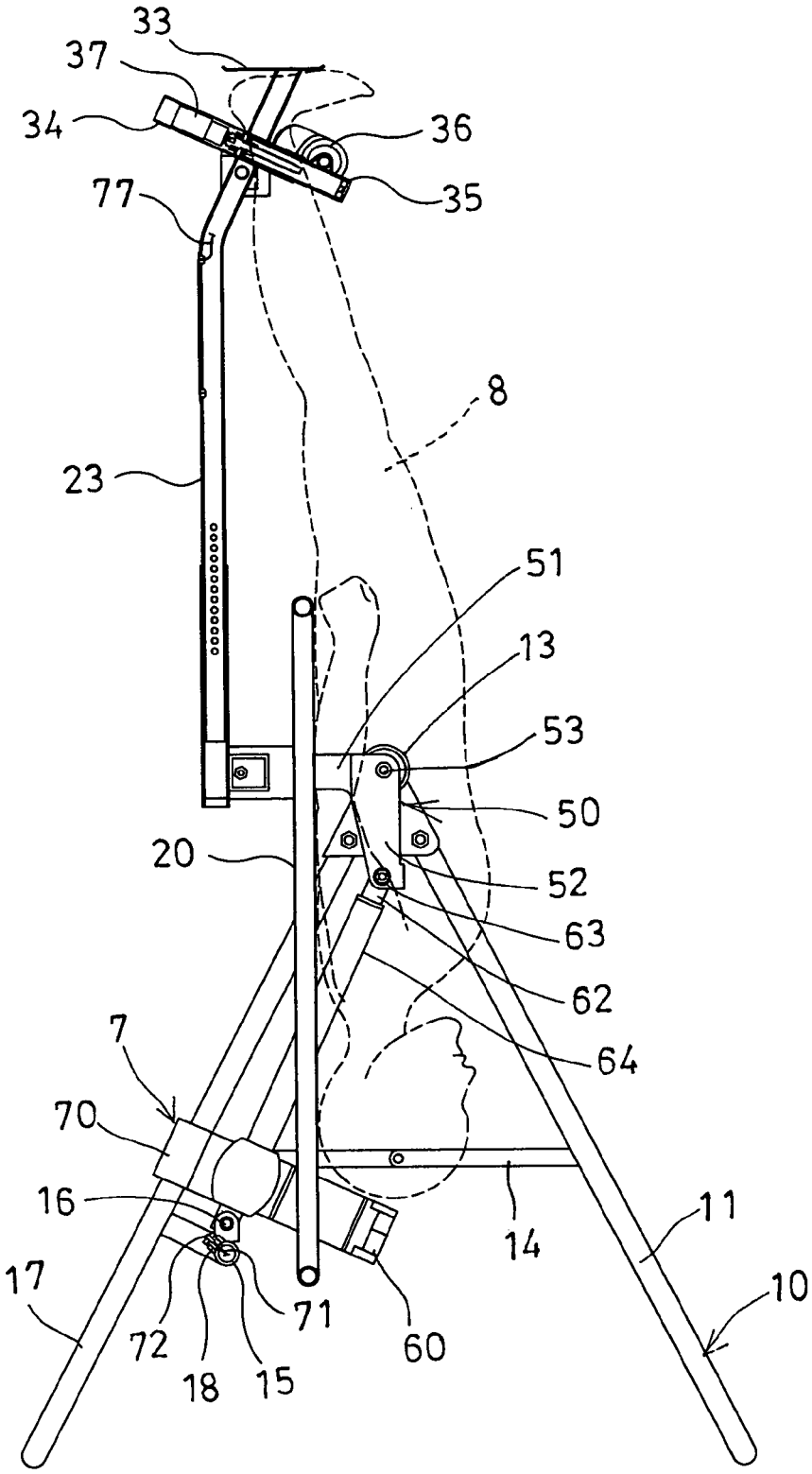
FIG. 9 is a further partial cross sectional view similar to FIGS. 4 and 8, illustrating the operation of the tilting inversion exerciser.

It is to be noted that, as shown in FIGS. 4 and 8-9, the table 20 is attached to or coupled to the bearing supports 13 of the stationary supporting stand 10 with the arms 51 and the axles 53 of the pivot coupling devices 50 such that the table 20 may be offset from the bearing supports 13 of the stationary supporting stand 10 and the axles 53 of the pivot coupling devices 50, and such that the center of gravity of both the table 20 and the user 8 will be located at or close to the center of gravity of the stationary supporting stand 10 (FIG. 9), and such that the tilting inversion exerciser in accordance with the present invention may be stably operated particularly when the user is conducting the inversion exercises.

A power rotating or driving means or device 6 is provided for rotating or driving or tilting the table 20 relative to the lower supporting stand 10 and for allowing the table 20 to be rotated relative to the lower supporting stand 10 to a vertical position relative to the lower supporting stand 10 and the ground (FIG. 9), and includes a motor 60 pivotally or rotatably attached or secured to the bracket 16 of the lower supporting stand 10, and a bolt or threaded member 61 (FIG. 2) threaded with a tube 62 that may be pivotally coupled to the bracket 55 or the free end portion of the other arm 52 of one of the pivot coupling devices 50 with such as a pivot pin 63, and thus for adjustably coupling the pivot coupling devices 50 and thus the table 20 to the lower supporting stand 10.

The bolt or threaded member 61 is coupled to and rotated and driven by the motor 60, for allowing the threaded member 61 and the tube 62 to be extended or retracted relative to each other by the motor 60, and thus for rotating the pivot coupling devices 50 and thus the table 20 relative to the lower supporting stand 10. It is preferable that the power rotating or driving device 6 further includes a protective outer covering or sheath or barrel or sleeve 64 attached to or extended from the motor 60 and engaged onto the threaded member 61 and also partially engaged onto the tube 62 for shielding and protecting the threaded member 61 and for preventing the threaded member 61 from being exposed and damaged by dirt and also for preventing people from being hurt by the threaded member 61.

In operation, as shown in FIG. 4, the user may be supported on the table 20 and may have his ankle portion detachably attached to or secured to the table 20 with the foot retaining device 30, for example, the motor 37 may be controlled or operated to move the stem 35 and the foot anchor members 36 toward the fixed foot supports 31 of the extension 28 in order to clamp and to retain the feet of the user to the foot retaining device 30 (FIG. 8). The power rotating or driving device 6 may be used as a rotating or actuating or operating means to rotate the pivot coupling devices 50 and thus the table 20 relative to the lower supporting stand 10, to allow the table 20 to be rotated to a position completely perpendicular to the ground (FIG. 9), and to allow the user to be freely suspended above the ground to comfortably conduct the tilting inversion exercises when the table 20 is vertically supported on the lower supporting stand 10.

Alternatively, the power rotating or driving device 6 may include an actuator (not shown), such as a pneumatic or hydraulic cylinder pivotally or rotatably attached or secured to the bracket 16 of the lower supporting stand 10, and includes a piston rod (not shown) extended therefrom and coupled to the bracket 55 or the free end portion of the other arm 52 of one of the pivot coupling devices 50 for rotating the pivot coupling devices 50 and thus the table 20 relative to the lower supporting stand 10 to any selected angular positions.

It is to be noted that, with the coupling of the pivot coupling devices 50 to the table 20, the tube 62 is required to be extended or moved relative to the lower supporting stand 10 for only a short moving stroke, by the motor 60 of the power rotating or driving device 6, to allow the table 20 to be rotated to the position completely perpendicular to the ground, and to allow the center of gravity of both the table 20 and the user 8 to be located on or closer to the center of gravity of the supporting stand 10, and thus for allowing both the supporting table and the user to be stably supported on the supporting stand 10 particularly when the user is conducting the inversion exercises.

It is further to be noted that the table 20 is attached or coupled to the bearing supports 13 of the stationary supporting stand 10 with the arms 51 and is thus offset from the axles 53 and the bearing supports 13 of the stationary supporting stand 10, and the tube 62 of the power rotating or driving device 6 is coupled to the bracket 55 or the free end portion of the other arm 52 of one of the pivot coupling devices 50 that is also offset from and the axles 53 and the bearing supports 13 of the stationary supporting stand 10 such that the power rotating or driving device 6 may rotate or tilt the table 20 and the user 8 relative to the stationary supporting stand 10 with a smaller force. The power rotating or driving device 6 has also been disclosed and filed in another co-pending U.S. Patent Application simultaneously and separately.

The present invention is to further provide a safety means or device 7 for switching off the ankle holder or foot retaining device 30 and for preventing the ankle holder or foot retaining device 30 from being operated or actuated inadvertently, particularly when the tilting inversion exerciser is rotated or operated relative to the supporting stand 10 by the user, to prevent the user from failing down from the table inadvertently. The safety device 7 includes a controller or control box or control device 70 attached to such as the frames 11 or the lever 15 of the lower supporting stand 10 or to the motor 60 of the power rotating or driving device 6, or to the threaded member 61 for controlling the operation of the motor 60 and/or the motor 37.

As shown in FIGS. 1-5, the lower supporting stand 10 includes a pad 18 disposed or attached to such as the lever 15 and having two orifices 19 formed therein. The control device 70 includes an electric cable 71 coupled thereto and coupled to two conductors or switch contacts 72, 73, in which the electric cable 71 may be engaged into the lever 15 of the lower supporting stand 10, and the switch contacts 72, 73 may be engaged into the orifices 19 of the pad 18 and partially exposed or extended out of the pad 18, best shown in FIG. 5. The table 20 includes an insulating member 24 attached to the extension 23 for engaging with the pad 18 and for cushioning the extension 23 and for preventing the extension 23 from striking onto the lever 15.

The motor 37 of the foot retaining device 30 further includes an electric cable 77 coupled thereto and coupled to two conductors 74, 75 which are longitudinal and which may be attached to the insulating member 24 for selectively engaging with the switch contacts 72, 73 of the control device 70 respectively and thus for electrically coupling to the control device 70, and thus for allowing the motor 37 of the foot retaining device 30 to be selectively controlled and actuated by the control device 70, or for allowing the motor 37 of the foot retaining device 30 to be selectively switched off particularly when the tilting inversion exerciser is rotated or operated relative to the supporting stand by the user.

Figure 6:
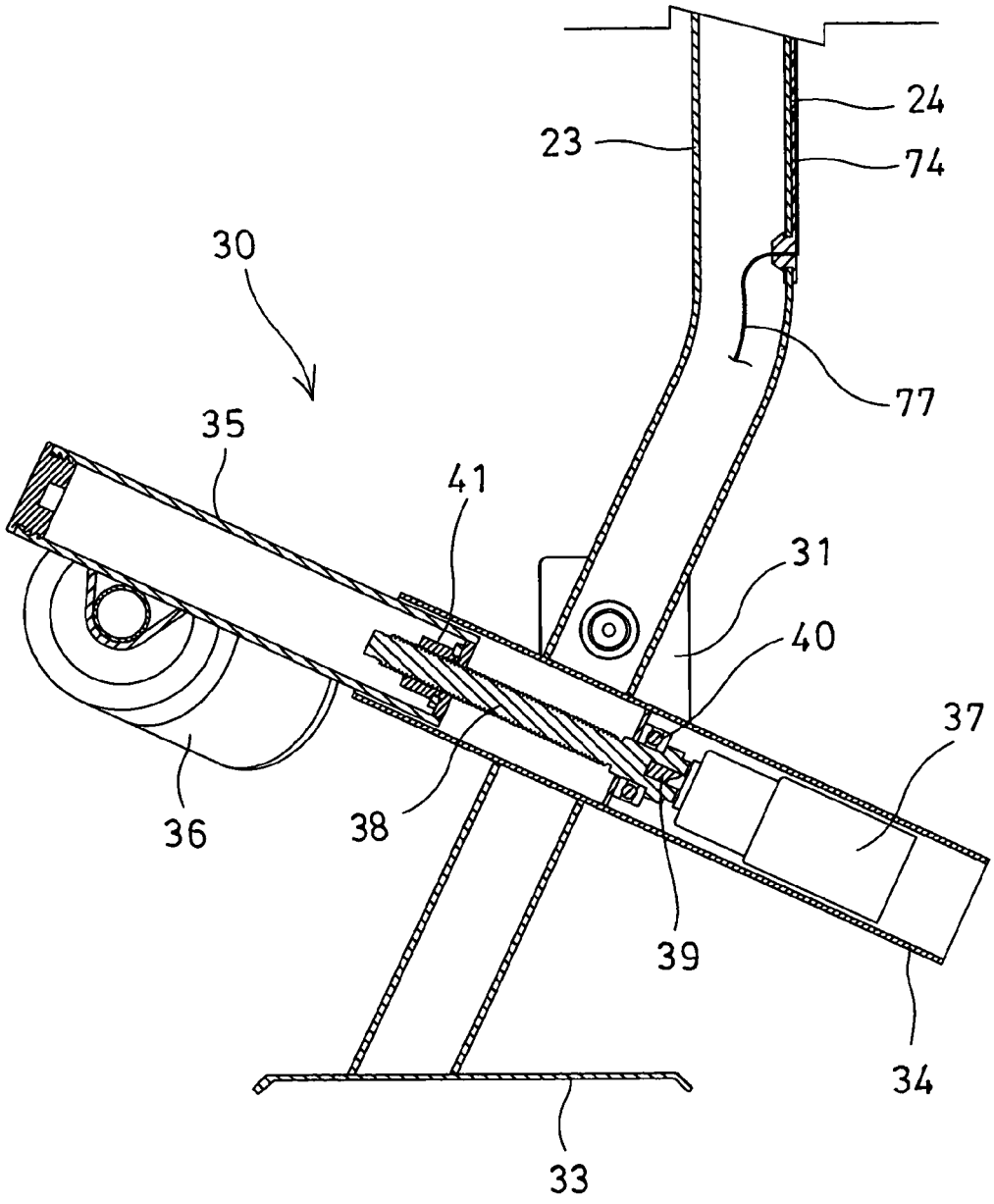
FIG. 6 is another enlarged partial sectional view of the tilting inversion exerciser.
Figure 7:
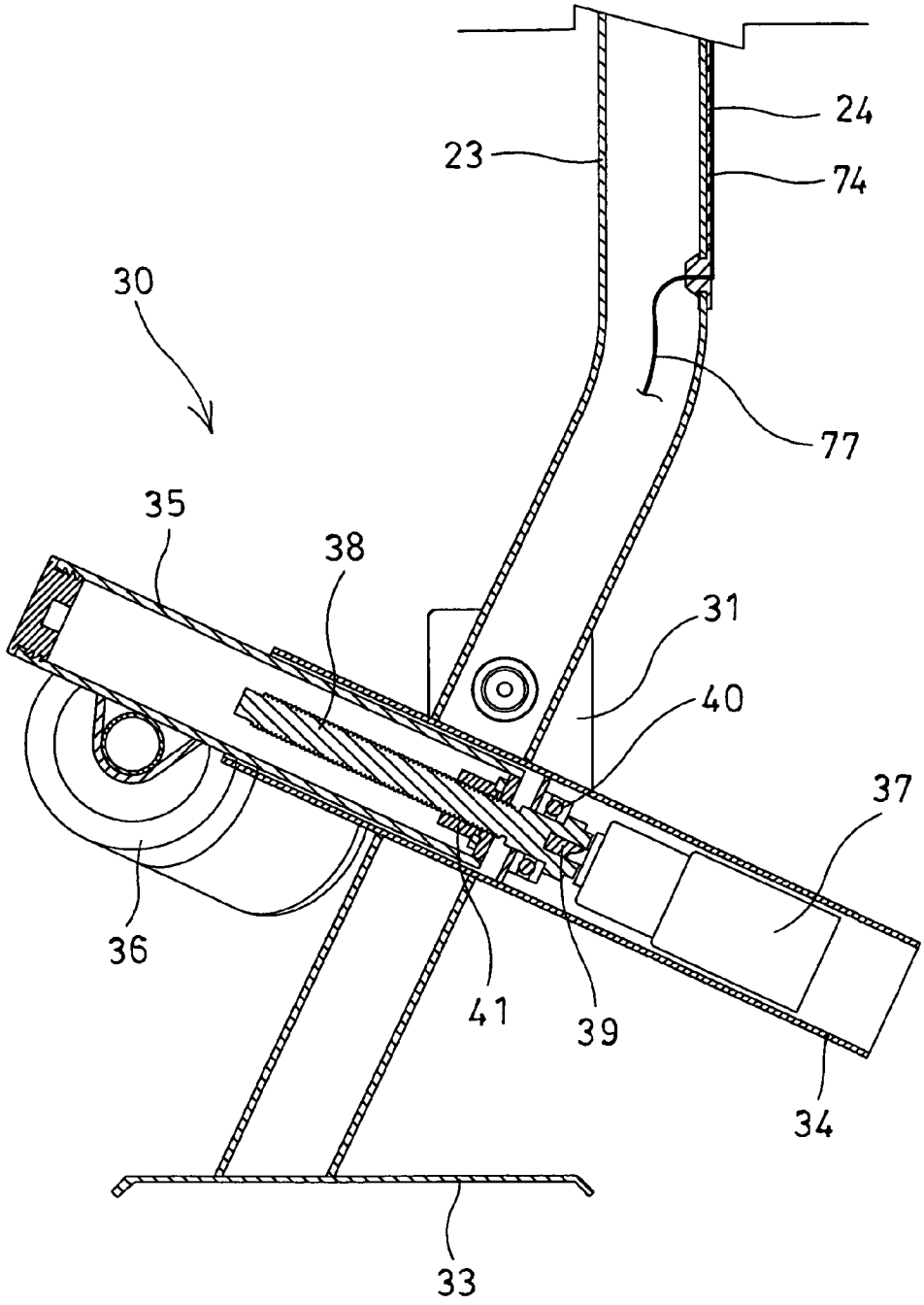
FIG. 7 is a further enlarged partial sectional view similar to FIG. 6, illustrating the operation of the tilting inversion exerciser.

In operation, as shown in FIGS. 2-5, when the extension 23 of the table 20 is engaged with and cushioned by the pad 18 of the lever 15 of the lower supporting stand 10, the conductors 74, 75 of the motor 37 of the foot retaining device 30 may be forced to engage with and to electrically couple to the switch contacts 72, 73 of the control device 70, such that, at this moment, the motor 37 of the foot retaining device 30 may be controlled and actuated or operated by the control device 70 to move the stem 35 and the foot anchor members 36 toward the fixed foot supports 31 of the extension 28 in order to clamp and to retain the feet of the user to the foot retaining device 30 (FIGS. 6-8).

As shown in FIG. 9, after the feet of the user have been solidly or firmly clamped and retained to the foot retaining device 30, or when the extension 23 of the table 20 is disengaged from the pad 18 of the lever 15 of the lower supporting stand 10, and when the conductors 74, 75 of the motor 37 of the foot retaining device 30 are disengaged from the switch contacts 72, 73 of the control device 70, the motor 37 of the foot retaining device 30 may no longer be controlled and actuated or operated by the control device 70 such that the feet of the user will not be disengaged from the foot retaining device 30 inadvertently, and such that the user may safely conduct the tilting inversion exercises and such that the user need not to worry about the inadvertently disengagement from the foot retaining device 30.

It is to be noted that the typical tilting inversion exercisers failed to provide a safety device 7 for switching off the ankle holder or foot retaining device 30 and for preventing the ankle holder or foot retaining device 30 from being operated or actuated inadvertently, particularly when the tilting inversion exerciser is rotated or operated relative to the supporting stand 10 by the user, and thus to prevent the user from failing down from the table 20 inadvertently.

Accordingly, the tilting inversion exerciser in accordance with the present invention includes a power rotating ankle holder or foot retaining device for being powered to grasp and retain or to detachably secure the ankle portions of the user to the tilting inversion exerciser, and includes a safety device for switching off the ankle holder or foot retaining device and for preventing the ankle holder or foot retaining device from being operated or actuated inadvertently, particularly when the tilting inversion exerciser is rotated or operated relative to the supporting stand by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tilting inversion exerciser comprising: a supporting stand, a table rotatably supported on said supporting stand with a pivot axle for supporting a user on said table, said table including two fixed foot supports for supporting the feet of the user, a power actuating foot retaining device attached to said table for being powered and actuated to clamp and to retain ankle portions of the user to said table, said foot retaining device including a tube attached to said table, a stem slidably attached to said tube, two foot anchor members attached to said stem and movable toward and away from said fixed foot supports for clamping and retaining the feet of the user to said table, a threaded shank rotatably disposed in said tube, and a threaded member secured in said stem and threaded with said threaded shank for allowing said threaded member and said stem to be moved and adjusted relative to said tube and for moving said foot anchor members relative to said fixed foot supports, said foot retaining device further includes an extension extended from said table for supporting said tube and said fixed foot supports wherein said extension includes an insulating member attached to said extension for engaging at least a conductor of a motor, and a control device for switching off said foot retaining device to prevent the ankle portions of the user from being disengaged from said foot retaining device inadvertently when said table is operated by the user.

2. The tilting inversion exerciser as claimed in claim 1, wherein a motor is coupled to said threaded shank for rotating and driving said threaded shank.

3. The tilting inversion exerciser as claimed in claim 2, wherein two switch contacts are coupled to said control device for selectively coupling to said motor.

4. The tilting inversion exerciser as claimed in claim 3, wherein two conductors are coupled to said motor for selectively engaging with said switch contacts of said control device.

5. A tilting inversion exerciser comprising: a supporting stand, a table rotatably supported on said supporting stand with a pivot axle for supporting a user on said table, said table including two side portions, two pivot coupling devices each including an axle provided on a middle portion thereof for pivotally attaching to said supporting stand, and each including a first arm extended therefrom and secured to said side portions of said table respectively, for allowing said table to be offset from said axles of said pivot coupling devices, a first pivot coupling device of said pivot coupling devices including a second arm extended therefrom, a power actuating foot retaining device attached to said table for being powered and actuated to clamp and to retain ankle portions of the user to said table, a control device for switching off said foot retaining device to prevent the ankle portions of the user from being disengaged from said foot retaining device inadvertently when said table is operated by the user and a motor-driven threaded member for coupling to said second arm of said first pivot coupling device and for rotating said pivot coupling device and said table relative to said supporting stand wherein said tube is coupled to said second arm of said first pivot coupling device and threaded with said threaded member and said second arm of said first pivot coupling device includes a bracket provided on a free end portion for coupling to said tube.

6. The tilting inversion exerciser as claimed in claim 5, wherein a motor is attached to said supporting stand, and said threaded member is coupled to and rotated and driven by said motor.

7. The tilting inversion exerciser as claimed in claim 5, wherein a sleeve is extended from said motor and engaged onto said threaded member for shielding and protecting said threaded member.

8. The tilting inversion exerciser as claimed in claim 5, wherein said first arm and said second arm of said first pivot coupling device form an L-shaped structure.

* * * * *